US006014942A

United States Patent [19]

Perka et al.

[11] Patent Number: 6,014,942

[45] Date of Patent: Jan. 18, 2000

[54] WORKSTATION SIGNAL DEVICE

[76] Inventors: Alan T. Perka; Cathy S. Perka, both of 4401 Southfield Ct., Wilmington, N.C. 28405

[21] Appl. No.: 08/826,023

[22] Filed: Mar. 28, 1997

[51] Int. Cl.[7] ..... G09F 17/00

[52] U.S. Cl. ..... 116/309; 116/316; 116/319; 116/173

[58] Field of Search ..... 116/303, 305, 116/306, 307, 309, 313, 316, 319, 173; 40/492, 484, 907, 530, 533, 534, 535, 536, 537, 601, 606; 160/10; 52/38

[56] References Cited

U.S. PATENT DOCUMENTS

| | | | |
|---|---|---|---|
| 391,185 | 10/1888 | Parker | 116/319 |
| 684,820 | 10/1901 | Hilgendorf | 40/907 |
| 937,264 | 10/1909 | Philbrick | 40/492 |
| 1,096,444 | 5/1914 | McClung . | |
| 1,448,903 | 3/1923 | Smith | 116/307 |
| 1,513,017 | 10/1924 | Thornburgh | 40/492 |
| 1,584,559 | 5/1926 | Kroger . | |
| 2,025,151 | 12/1935 | Brillinger | 116/319 |
| 2,610,604 | 9/1952 | Edwards | 116/319 |
| 2,706,352 | 4/1955 | Clark | 40/492 |
| 2,798,320 | 7/1957 | Montalto | 116/319 |
| 3,109,634 | 11/1963 | Anson | 116/309 |
| 3,139,611 | 6/1964 | Fleming . | |
| 3,315,634 | 4/1967 | Sherrill . | |
| 3,323,485 | 5/1965 | Guth . | |
| 4,070,775 | 1/1978 | Brooks . | |
| 5,058,523 | 10/1991 | Mikkonen et al. | 116/309 |
| 5,328,039 | 7/1994 | Heimendinger | 40/606 |

FOREIGN PATENT DOCUMENTS

| | | | |
|---|---|---|---|
| 636390 | 4/1950 | United Kingdom | 40/492 |

*Primary Examiner*—Andrew Hirshfeld
*Attorney, Agent, or Firm*—Rhodes & Mason, PLLC

[57] ABSTRACT

A signal device including a plurality of visually different flags in a mounting frame is secured to the top of a cubicle wall forming a part of a workstation, so that the status of the workstation user can be visually determined. The flags are normally in a generally horizontal position in the mounting frame, and may be in a recess in the top of the cubicle wall. A flag corresponding to the desired message is raised from the mounting frame, so that the flag is visible above the top of the cubicle wall.

3 Claims, 2 Drawing Sheets

2
42
38
36
34
10
40
32
3
24
28
30
14
22
26
12
42
3
2
20
16
44
48

32
28
30
34
22
24
26
16

18
20
46
48

40
32

38
30
14
12

WORKSTATION SIGNAL DEVICE

BACKGROUND OF THE INVENTION (1) Field of the Invention

The present invention relates generally to a signal device for use in association with a cubicle or workstation, and in particular to a signal device for use on a cubicle wall to visually indicate the status of the person normally occupying the workstation.

(2) Description of the Prior Art

Modern work environments, instead of being constructed of fixed offices with floor to ceiling walls, are often formed by dividing a large open area into a plurality of workstations, or cubicles, which can serve as offices, conference areas, specialized work areas, etc. These workstations are formed using movable partitions, often called cubicle walls. These cubicle walls may be of different heights, widths and lengths. Generally, however, the wall will be low enough so that a person of average height inside a workstation can see the tops to other workstations. A cubicle wall commonly found in office environments is approximately 4 to 6 feet high, 1 to 3 inches thick, and 2 to 6 feet long. Cubicle walls are normally formed of an outer frame that forms the top, bottom and end sections of the cubicle walls, and side sections extending across the frame. The interior of the cubicle wall between the sections may be hollow or insulated.

Work environments of this nature are commonly comprised of a large number of workstations extending over a large space. One of the needs experienced by an individual working in a workstation is to determine the status of the user of another workstation, i.e., whether or not the user of another workstation is present or absent, and whether the user is available. While the height of the wall is normally low enough for an individual of average height to see over the wall while standing, and view the tops of cubicle walls forming other workstations, a user seated inside a workstation normally cannot be seen by those in other workstations.

Thus, if the user of one workstation wishes to communicate with the user of another workstation, the first workstation user must physically go to the second workstation or telephone the second workstation, assuming that the workstation has a telephone. In the first case, considerable time can be wasted if the other user is not present, or is otherwise engaged. Use of a telephone, while quicker, can be disruptive if the second user is in a meeting, or otherwise involved in an activity that should not be interrupted.

Therefore, it would be highly convenient if there was a means whereby the user of one workstation could determine the status of the user of a second workstation by mere visual inspection, without the need to physically go to the other workstation, or risk interruption of some activity.

SUMMARY OF THE INVENTION

The present invention is directed to a device for visually communicating the status of a workstation user to others.

The invention relates especially to a signal device that can be attached to the upper part of a workstation or cubicle wall, so that persons who are able to see the top of the wall are able to quickly determine if the user is present or absent, and if the user is available.

Essentially, the signal device of the present invention is comprised of a plurality of different flags or indicators that can be individually extended upwardly above the top of the cubicle wall, so that the extended flag can be viewed at a distance. The individual flags are visually different, so that a different meaning will be communicated by each flag to a person understanding the significance of the different flags. For example, the flags may be of different colors or different shapes. The difference in the flags should be apparent from all sides of the flag, so that the desired information can be determined from all directions.

As used herein, the term "flag" is intended in its broadest sense to mean an indicator that is raised to a visible position to communicate a signal. Thus, "flags" are defined herein as elongated members with a inner, attached end, and an outer, unattached end. The outer end may include an enlarged section, that may extend from one side of the elongated member. The "flag," however, may be simply in the form of a rod or staff.

The visual differences in the flags will communicate different information to an observer who is familiar with the meanings assigned to the various differences. For example, one flag may be colored green to indicate that the user is available, another yellow indicating that the user can be interrupted if the matter is important, another red to signal that the user is not to be disturbed unless the matter is urgent, and yet another blue to advise that the user is away from the workstation.

The plurality of flags are attached to a support or mounting frame that is, in turn, adapted to be secured to the top of the cubicle wall. The attachment is such that a single flag can be individually deployed upwardly, while the remaining flags are held in a lowered position. For example, the flags can be pivotally secured at one end to the mounting frame, e.g., by a pin extending through a hole near one end of the flag. The flag can then be pivoted from horizontal to vertical when it is desired to be deployed. Alternatively, the flags can stored in a vertical position, with the desired flag being extended upwardly.

The mounting frame is designed so that it can be attached to the upper part of the cubicle wall, and includes a gripping member or clamp to secure the device to the wall. The gripping member may be of different forms. For example, the gripping member may include an adjustable section that can be tightened against the wall, or the mounting frame may include spaced sides that frictionally grip opposed sides of the cubicle wall, or a segment thereof. A spring or other tensioning member may also be added for this purpose.

The device can be designed for attachment to existing cubicle walls, or the cubicle wall and signal device can be designed together, so that the device forms an integral part of the wall. Thus, instead of mounting the device onto the upper part, e.g., the top, of the cubicle wall, the cubicle wall can be specifically designed so that the signal device is housed in a recess in the top of the cubicle wall, with the desired flag being raised from the recess. In this embodiment, the invention is comprised of the wall having a recess in its top surface or wall segment, with the signal device being positioned in the recess.

Devices to communicate information visually by raising an appropriate flag are per se known in the prior art. For example, U.S. Pat. No. 3,315,634 to Sherrill describes a loom flag for use in a textile mill. The loom flag is comprised of an attachment bracket to mount the loom flag onto the loom, and a plurality of pivotal flags that can be independently raised by the loom operator to signal a mechanic, or indicate the status of the loom.

U.S. Pat. No. 3,139,611 to Fleming describes a portable trouble signal comprised of a plurality of pivotal flags mounted on the end of a flashlight, which includes a magnet.

The owner of a vehicle wishing to signal others of his need or status raises the appropriate flag and attaches the devise to the vehicle using the magnet. At night, the flashlight can be turned on the illuminate the flag.

U.S. Pat. No. 4,070,775 to Brooks describes an emergency road sign comprised of a plurality of flags pivotally attached at one end to each other. The appropriate flag can be raised to the vertical position and the device placed upon a horizontal surface.

U.S. Pat. No. 2,798,320 to Montalto describes a signal device to be mounted on the door of an examination room in a doctor's office. The device includes a plurality of pivotal flags of different colors to indicate different circumstances. The appropriate flag is pivoted to a horizontal position so that it can be seen by the doctor.

U.S. Pat. No. 3,323,485 to Guth describes an indicator board used to indicate the presence or absence of physicians by flipping an indicator up or down to display a different color.

U.S. Pat. No. 1,096,444 to McClung describes a signal device to be attached to a door. One flag can be raised to indicate that the occupant is away from the office, and another flag can be raised to indicate where the occupant has gone.

U.S. Pat. No. 1,584,559 to Kroger describes a signaling device comprised of a wheel with information printed in segments thereon. The wheel is covered by a transparent colored covering with a cut out section. The covering is rotated to expose the appropriate segment of the wheel.

However, while signal devices comprised of a plurality of visually different flags have been used in the prior art to communicate a signal or information, the prior art does not suggest the use of devices of this type in association with the moveable partitions or cubicle walls of a workstation to inform others of the status of the workstation user.

Accordingly, one aspect of the present invention is to provide a signal device to be mounted on the upper part of a workstation wall, whereby the status of the workstation user can be determined by viewing the top of the workstation wall, the device comprising a mounting frame attachable to the wall, and at least to two signal flags having different visual appearances that can be independently raised to an upright position.

Another aspect of the present invention is to provide a signal device to be mounted in a recess in the upper surface of a workstation wall, whereby the status of the workstation user can be determined by viewing the top of the workstation wall, the device comprising a mounting frame including a housing insertable into a recess in the top of a cubicle wall, and at least to two signal flags having different visual appearances in the housing, the flags being independently extendible to an upright position above the top of the cubicle wall.

Still another aspect of the present invention is to provide a cubicle wall having an upper planar surface with a recess therein, and a signal device mounted in the recess, the device including at least two signal flags having different visual appearances that can be individually raised above the top of the upper planar surface, whereby the raised flag can be seen by a person at a distance to visually determine the status of a user in a workstation including the cubical wall.

Still another aspect of the invention is to provide a method for visually communicating the status of a workstation user comprising the steps of providing a plurality of flags on the top of a wall forming the cubicle, and raising the flag corresponding to the information to be communicated.

These and other aspects of the present invention will become apparent to those skilled in the art after a reading of the following description of the preferred embodiment.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation.

Figure 1:
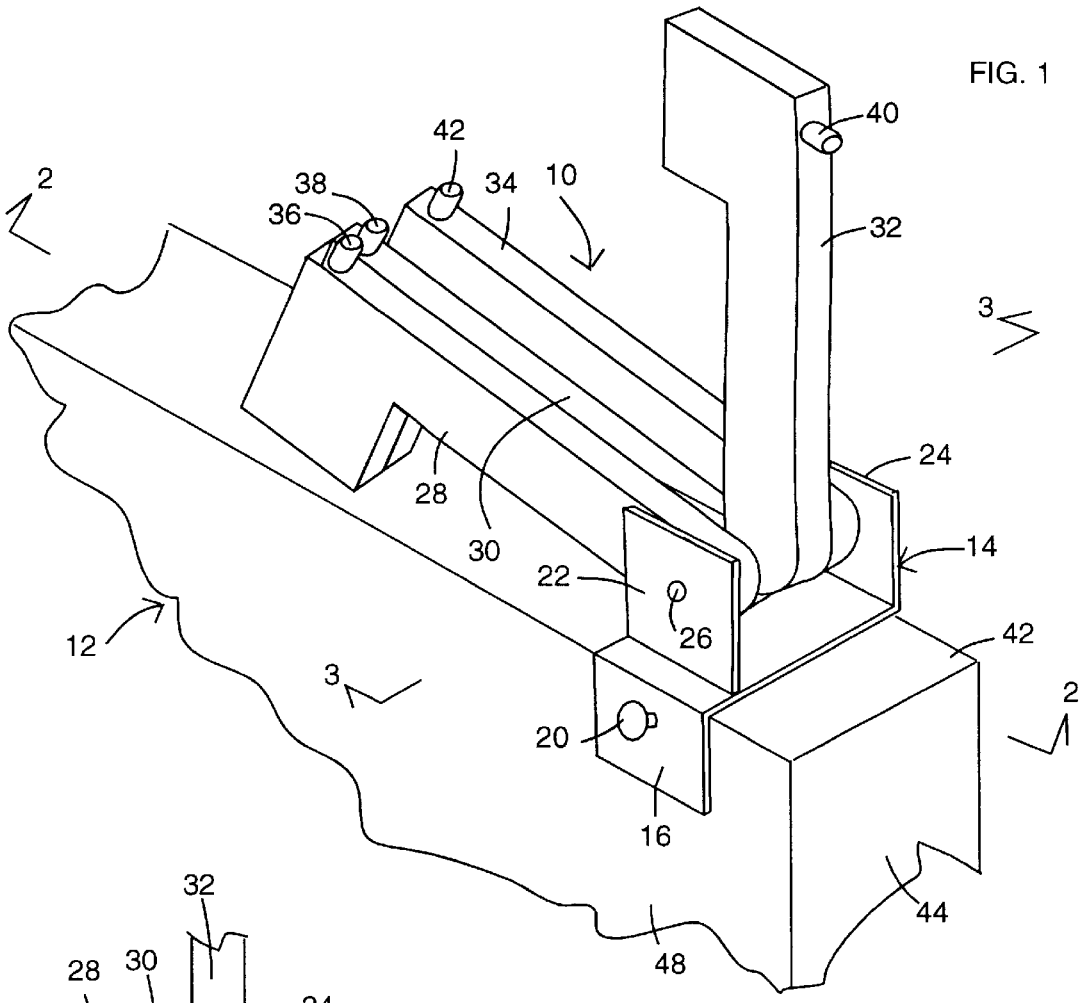
FIG. 1 is a perspective view of an embodiment of the invention designed for mounting on the top of an existing cubicle wall.
Figure 3:
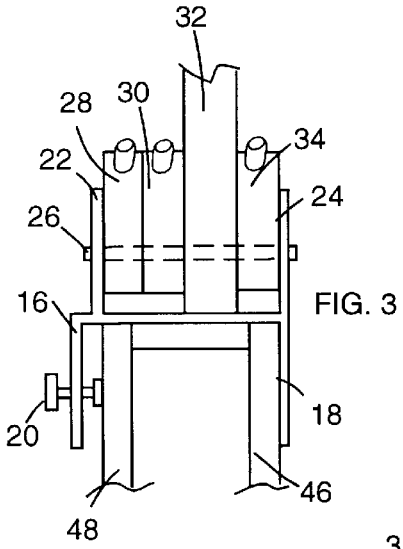
FIG. 3 is a sectional end view of the embodiment of FIG. 1, along line 3—3.
Figure 2:
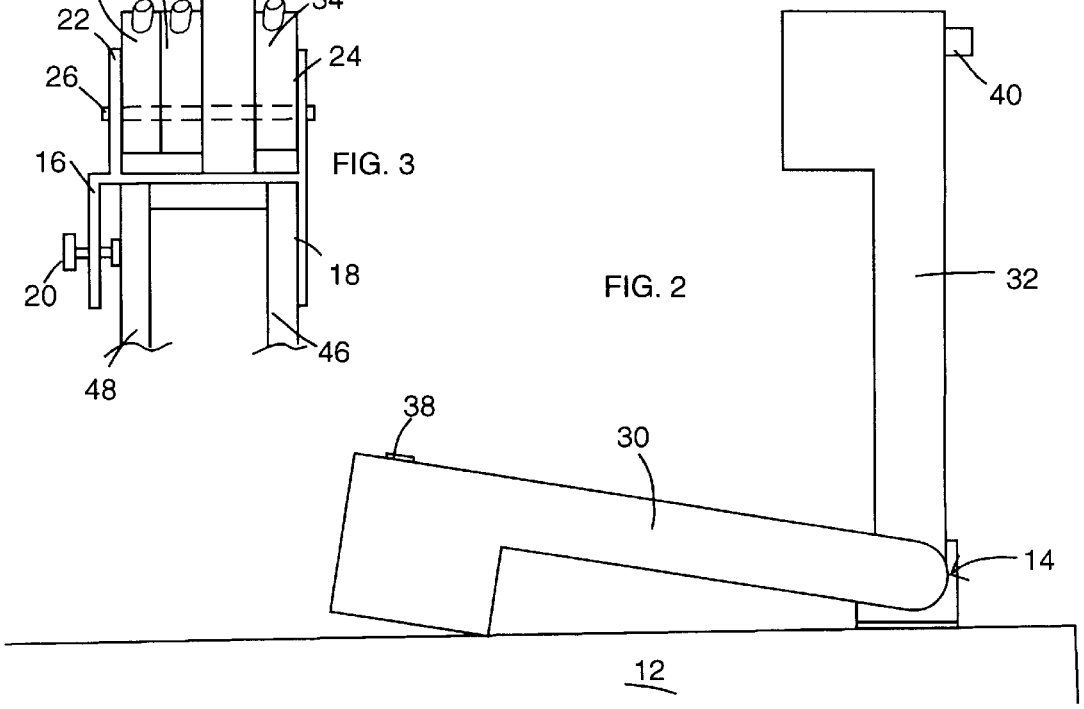
FIG. 2 is a sectional side view of the embodiment of FIG. 1, along line 2—2.

FIGS. 1–3 illustrate a signal device, generally 10, designed for mounting on an existing cubicle wall, generally 12. Device 10 is comprised of a mounting frame, generally 14, that includes downwardly extending arms 16 and 18, and an adjustable clamp 20 to secure device 10 to the upper part of wall 12. Generally, arms 16 and 18 will be parallel to each other and spaced at a distance at equal to or slightly greater than the thickness of cubicle wall 12. Mounting frame 14 further includes a pair of spaced upright arms 22 and 24 and a horizontal pivot pin 26 extending between arms 22 and 24.

Device 10 further includes a plurality of flags 28, 30, 32 and 34 which have inner ends pivotally attached to pivot pin 26. The upper ends of flags 28–34 include enlarged end sections to increase visibility. Flags, 28–34 also include upstanding grasping members 36,38, 40 and 42 adjacent their outer ends to aid in grasping of an individual flag so that the flag can be raised to the upright position, such as that shown for flag 32 in FIGS. 1–3. Instead of the positioning shown, grasping members 36–42 can be staggered for ease in gripping, or moved to the outer ends of flags 28–34. The inner ends of flags 28–34 are positioned to snugly engage mounting frame 14, so that the raised flag will be held in position by the frictional engagement of the flag against frame 14. It will be understood that other positioning means may be employed to hold the flags in the desired position.

As shown if FIGS. 1–3, cubicle wall 12 is comprised of a top wall surface or section 42, an end wall section 44, an outer side wall section 46 and an inner side wall section 48. Normally, end wall section 44 will be adjacent a doorway or passageway into the workstation formed of the cubicle walls, since this position will normally be most convenient to the workstation user, and readily visible to one seeking access to the workstation. Device 10, however, may be positioned at other locations on the wall.

Figure 4:
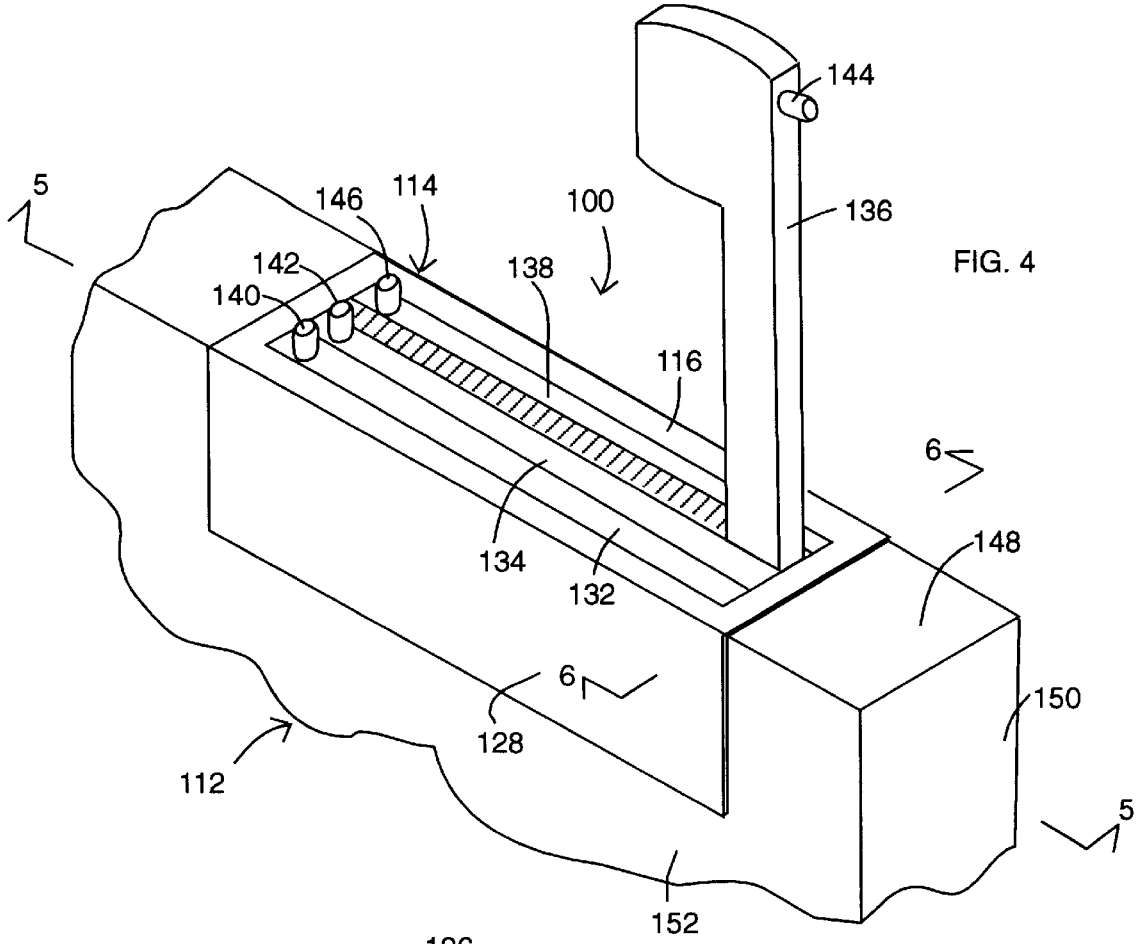
FIG. 4 is a perspective view of another embodiment of the invention designed for mounting in a recess in the top of a cubicle wall.
Figure 6:
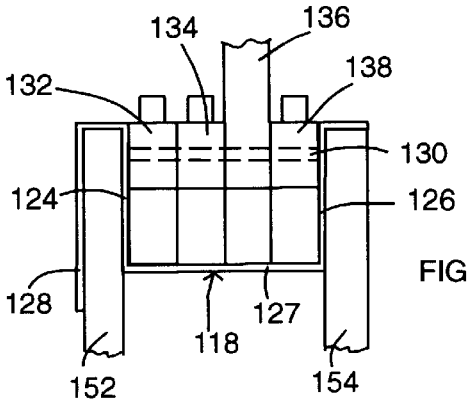
FIG. 6 is a sectional end view of the embodiment of FIG. 4, along line 6—6.
Figure 5:
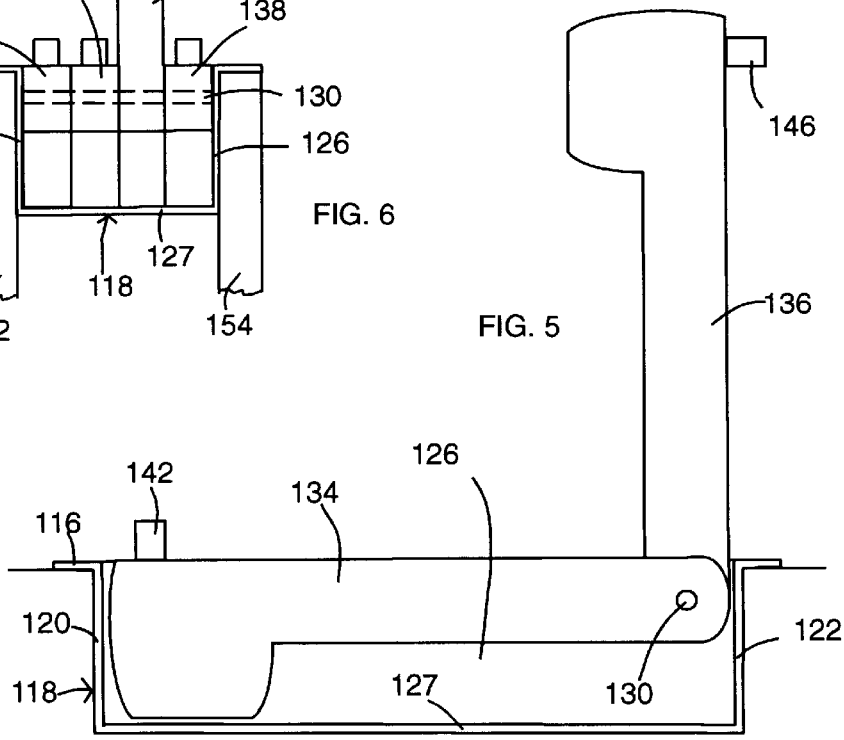
FIG. 5 is a sectional side view of the embodiment of FIG. 4, along line 5—5.

FIGS. 4–6 illustrate a second device, generally 100, embodying the invention for mounting into a recess in a cubicle wall, generally 112. Device 100 is comprised of a mounting frame, generally 114, comprised of an upper plate 116, and a box-shaped housing 118. Housing 118, attached beneath an opening in plate 116, is formed of spaced end walls 120 and 122, a front side wall 124, a rear side wall 126, and a bottom wall 127. A generally vertical front plate 128 extends downwardly from the front edge of plate 116 and parallel to, and spaced from, front side wall 124 of housing 118. A horizontal pivot pin 130 extends horizontally between front and rear housing walls 124 and 126. It should be understood that housing 118 need not be entirely enclosed, so long as housing 118 includes a means to attach the inner ends of the flags, and a stop to support the flags in a generally horizontal, or generally vertical position.

Device 100 further includes a plurality of flags 132, 134, 136 and 138, which have their inner ends pivotally attached to pivot pin 130. As in the embodiment shown in FIGS. 1–3, the upper ends of flags 132–138 include enlarged end sections to increase their visibility. Flags 132–138 also include upstanding grasping members 140, 142, 144 and 146 to aid in grasping of an individual flag so that the flag can be raised to the upright position, such as that shown for flag 136. As with the other embodiment of the invention, the positioning of grasping members 140–146 can be staggered for ease in gripping, or the members can be moved to the outer ends of flags 132–138. The lower ends of flags 132–138 are positioned to snugly engage end wall 122, so that the raised flag will be held in an upright position by the frictional engagement of the flag. Other means can be employed to hold the flags in the desired position.

As shown if FIGS. 4–6, cubicle wall 112 is comprised of a top wall surface or section 148, an end wall section 150, an outer side wall section 152 and an inner side wall section 154. Signal device 100 is mounted within an opening in the upper surface of top wall section 148, and between side wall sections 152 and 154. In this manner, the flags of device 100 that are not in use can be housed within the interior of cubicle wall 112, to present an improved appearance, and reduced risk of damage to the flags.

Outer wall plate 128 and wall 124 of housing 118 are parallel to each other and spaced at a distance approximately equal to the thickness of outer side wall 152, so that plate 128 and wall 124 cooperate to snugly engage wall 152, thereby frictionally securing device 100 within the wall recess. Front plate 128, can also serve as a display board for information or messages, such as the name of the workstation user, or an explanation of the flags' meanings. The information can be secured to plate 128 in a variety of known ways, including magnetically, adhesively, or by the use of a mounting bracket.

Operation of the device is both simple and effective. Once device 10 or 100 is mounted on a workstation cubicle wall, it is only necessary for the user of the workstation to raise the appropriate flag, normally using the attached grasping member, to raise the flag to the vertically upright, visible position. Anyone familiar with the meaning of the different flags who wishes to determine the status of the workstation user can then merely look toward the top of the workstation wall to ascertain which flag is raised.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A workstation comprising:

a) a cubicle wall having an upper horizontal surface, vertical front and back wall segments, and a given thickness, said upper horizontal surface including a signal device receiving recess extending downwardly between said vertical wall segments; and b) a signal device mounted within said recess to visually indicate the status of a user of said workstation by viewing the top of the cubicle wall, said device including i) a housing located in said recess, said housing having vertical side walls, and a horizontal pivot pin extending between said side walls adjacent one end of said housing; and ii) a plurality of flags having inner and outer ends, each of said flags being attached at its inner end to said horizontal pin and being pivotal about its inner end between a generally horizontal lowered position within said housing between said housing side walls and a generally vertical position extending above said cubicle wall upper horizontal surface, said flags being substantially below the upper horizontal surface of said cubicle wall when said flags are in their respective lowered positions.

2. The workstation of claim 1, further including a horizontal upper plate supported on said upper wall, said upper plate including an opening into said housing.

3. The workstation of claim 2, wherein said upper plate includes an outer edge, said housing further including a vertical front plate extending downwardly from said outer edge against one of said vertical front and back wall segments.

* * * * *